US010442097B2

(12) United States Patent
Bozikis et al.

(10) Patent No.: US 10,442,097 B2
(45) Date of Patent: Oct. 15, 2019

(54) TRIMMING BLADE HEAD AND A RAZOR COMPRISING A RAZOR HANDLE AND SUCH A TRIMMING BLADE HEAD

(71) Applicant: BIC-VIOLEX SA, Anixi, Attiki (GR)

(72) Inventors: Ioannis Bozikis, Koukaki (GR); Efthymios Saltas, Nikea (GR); Panagiotis Moustakas, Petroupoli (GR); Phaedon Papageorgis, Agios Stefanos (GR)

(73) Assignee: BIC-VIOLEX S.A., Anixi (GR)

( * ) Notice: Subject to any disclaimer, the term of this patent is extended or adjusted under 35 U.S.C. 154(b) by 87 days.

(21) Appl. No.: 15/324,307

(22) PCT Filed: Aug. 7, 2014

(86) PCT No.: PCT/EP2014/066975
§ 371 (c)(1),
(2) Date: Jan. 6, 2017

(87) PCT Pub. No.: WO2016/020002
PCT Pub. Date: Feb. 11, 2016

(65) Prior Publication Data
US 2017/0210020 A1 Jul. 27, 2017

(51) Int. Cl.
*B26B 21/42* (2006.01)
*B26B 21/40* (2006.01)

(52) U.S. Cl.
CPC ..... *B26B 21/42* (2013.01); *B26B 21/4037* (2013.01)

(58) Field of Classification Search
CPC ..... B26B 21/4018; B26B 21/4025; B26B 21/4031; B26B 21/4037; B26B 21/4012; B26B 21/42
USPC ..... 30/81–84, 70, 73, 77, 41, 50, 210, 216, 30/223, 225
See application file for complete search history.

(56) References Cited

U.S. PATENT DOCUMENTS 2,612,684 A 10/1952 Mansfield
4,443,939 A * 4/1984 Motta ..... B26B 21/4012 30/49
5,386,750 A 2/1995 Morrison
6,243,951 B1 * 6/2001 Oldroyd ..... B26B 21/227 30/34.2
2009/0218252 A1 9/2009 Michel
2010/0011586 A1 * 1/2010 Nicoll ..... B26B 21/225 30/34.1

(Continued)

FOREIGN PATENT DOCUMENTS

GB 802 752 A 10/1958

OTHER PUBLICATIONS

International Search Report of PCT/EP2014/066975 dated Mar. 23, 2015.

*Primary Examiner* — Laura M Lee
(74) *Attorney, Agent, or Firm* — Polsinelli PC

(57) ABSTRACT

A trimming blade system has a front and includes a supporting plate, a blade, and a cover plate. The blade has a cutting edge facing forwardly toward the front of the trimming blade system. The trimming blade system has a comb provided with teeth which project forwardly toward the front of the trimming blade system and which overlap the cutting edge. Each of the teeth has an upper face, two lateral faces, and a lower face. The lower face of each of the teeth is joined to the lateral faces by opposite chamfered faces.

20 Claims, 12 Drawing Sheets

(56) References Cited

U.S. PATENT DOCUMENTS

2013/0199346 A1* 8/2013 Psimadas ..... B26B 21/225
83/13

* cited by examiner

TRIMMING BLADE HEAD AND A RAZOR COMPRISING A RAZOR HANDLE AND SUCH A TRIMMING BLADE HEAD

This application is a national stage application of International Application No. PCT/EP2014/066975, filed Aug. 7, 2014, the entire contents of which is incorporated herein by reference.

FIELD OF THE INVENTION

The embodiments of the present invention relate to a trimming blade system and a razor that includes a razor handle and such a trimming blade system.

BACKGROUND OF THE INVENTION

The invention is related to a trimming blade system having a front and including a supporting plate, a blade, and a cover plate. The blade has a cutting edge facing forwardly toward the front of the head. The trimming blade system has a comb provided with teeth which project forwardly toward the front of the head and which overlap the cutting edge. Each of the teeth has an upper face, two lateral faces and a lower face.

The invention also relates to a trimming blade system having a front and including a supporting plate, a blade, and a cover plate. The blade has a cutting edge facing forwardly toward the front of the trimming blade system, and the trimming blade system has a comb provided with teeth which project forwardly toward the front of the trimming blade system and which overlap the cutting edge.

Such trimming blade systems allow for precise hair trimming or grooming. In order to align the hair and raise it from the skin during shaving, the trimming blade head is provided with a comb. Because of the comb, there is no immediate contact of the skin with the blade. The comb allows for a separation of the hairs which leads to better trimming. The trimming distinguishes from the traditional shaving in that the trimmer is able to achieve a stubble look or to leave hair to a certain length, not shaving hair down to the skin. The comb is the only part to come in contact with the skin, and the first part to come in contact with the hair. The comb functions as a traditional comb, separating the hair. The blade follows the comb to cut the hair to the desired length.

The known heads including a comb are provided with a traditional blade and are thus not a trimming blade system.

Due to the comb in the known heads, the active length of the blade is reduced. In addition, due to the comb, a gap is created between the teeth of the comb and the blade(s) where unwanted hairs can trap. Therefore, more strokes are required promoting clogging, and overall less efficiency.

Therefore, the known trimming blade systems with a comb do not allow for trimming in good conditions.

SUMMARY OF THE INVENTION

To this aim, a trimming blade system is provided with a specific geometry allowing for good and a precise trimming.

One object of the present invention is to provide a trimming blade system where the lower face of each of the teeth is joined to the lateral faces by opposite chamfered faces. The object of the present invention increases, for example, the active length of the blade, the number of hairs that are being cut with a single stroke, and the available space in front.

The joining of the lower face of each of the teeth to the lateral faces results in an increase of the active length of the blade. In addition, the chamfered faces aim at reducing the possibility of hair clogging.

Another object of the present invention is to provide a trimming blade system where the teeth are stepped to form rearwardly directed shoulders against which the cutting edge is positioned and where each of the shoulders is provided with a shoulder chamfer. The object of the present invention increases, for example, the active length of the blade, the number of hairs that are being cut with a single stroke, and the available space in front.

The stepped teeth results in an increase of the active length of the blade. In addition, the shoulder chamfer aims at reducing the possibility of hair clogging.

In various embodiments of the present invention, one and/or the other of the following features may be incorporated in the skin contact member alone or in mutual combination.

The teeth are stepped to form rearwardly directed shoulders against which the cutting edge is positioned; in addition, each of the teeth is tapered toward the shoulder.

Each of the teeth defines an elbow extending forwardly toward the front of the system.

The upper face of the teeth defines a trimming plane, and the cutting edge is included in a blade plane which is parallel to the trimming plane.

The lower face of each of the teeth is flat, and the lower face of each of the teeth is partly adjacent to the blade.

The lateral faces of each of the teeth extend parallel to each other.

The cutting edge is elongated and defines a longitudinal axis, and the lateral faces of each of the teeth extend parallel to each other and extend transversally to the longitudinal axis.

The cutting edge is elongated and defines a longitudinal axis, and the lateral faces of each of the teeth extend parallel each other and extend perpendicularly to the longitudinal axis.

The teeth are spaced from each other by an interval having a value between about 1 mm and about 5 mm.

Each of the teeth has a length having a value between about 1 mm and about 15 mm. The length can have a value between about 0.5 mm and about 11 mm, or about 10.3 mm.

Each of the teeth has a width having a value between about 1 mm and about 4 mm. The width can have a value between about 0.8 mm and about 4 mm. The number of teeth is between 10 and 20.

The trimming blade system further includes a spacer sandwiched between the blade and the supporting plate.

The comb is provided on the cover plate.

The comb is provided on the support plate.

Another object of the present invention is to provide a razor including a razor handle and such a trimming blade system, the trimming blade system being provided with connecting means for connecting the trimming blade system to the razor handle. The razor handle can be connected to the trimming blade system pivotally or, in other examples, not pivotally; when the connection is pivotable, the connecting means can include shell bearings provided on the trimming blade system. In addition, the razor handle can be provided with a lock and release mechanism allowing the trimming blade system to be detachable from the razor handle.

Another object of the invention is to provide a razor including a razor handle, a shaving head and such a trimming blade system, the shaving head being provided with connecting means for connecting the shaving head to the razor handle. The razor handle can be connected to the shaving head pivotally or, in other examples, not pivotally; when the connection is pivotable, the connecting means can include shell bearings provided on the shaving head. In addition, the razor handle can be provided with a lock and release mechanism allowing the shaving head to be detachable from the razor handle.

BRIEF DESCRIPTION OF THE DRAWINGS

Other characteristics and advantages of the present invention will readily appear from the following description of several embodiments, provided as non-limitative examples, in reference to the accompanying drawings.

On the different figures, the same reference signs designate identical or similar elements.

DETAILED DESCRIPTION OF THE INVENTION

The figures illustrate a wet razor according to the present invention, including a razor handle 12 and a trimming blade system 10.

Figure 1A:
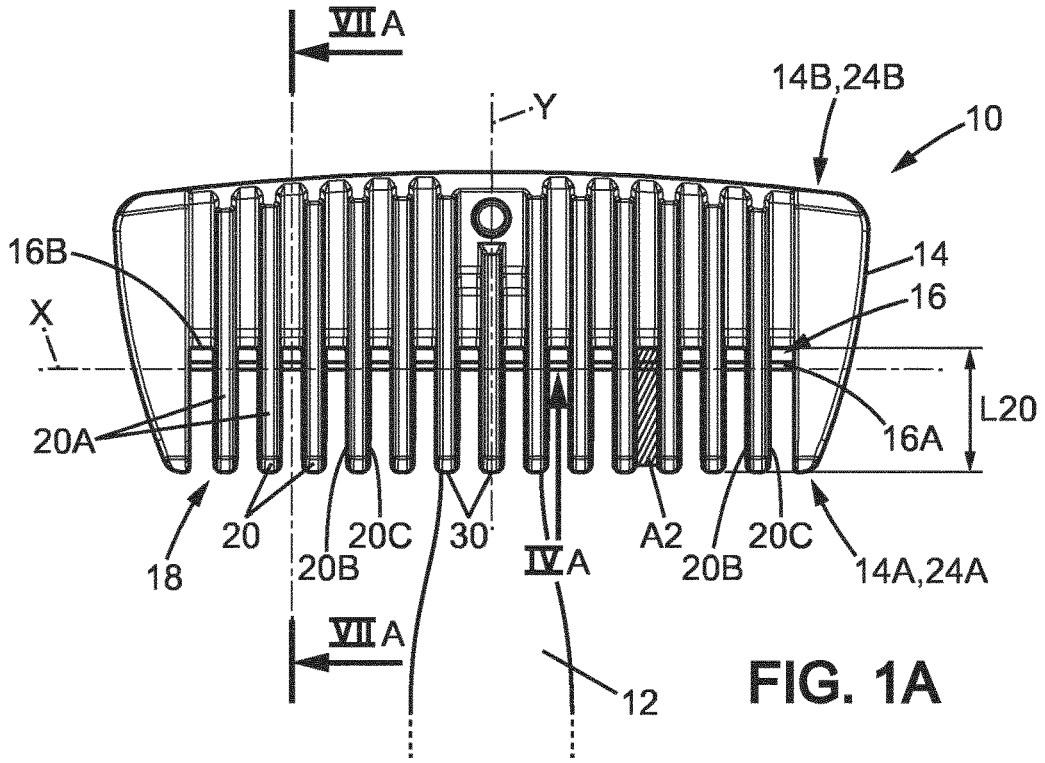
FIG. 1A is a front view of a razor according to the present invention, the razor including a trimming blade head and a razor handle.
Figure 1B:
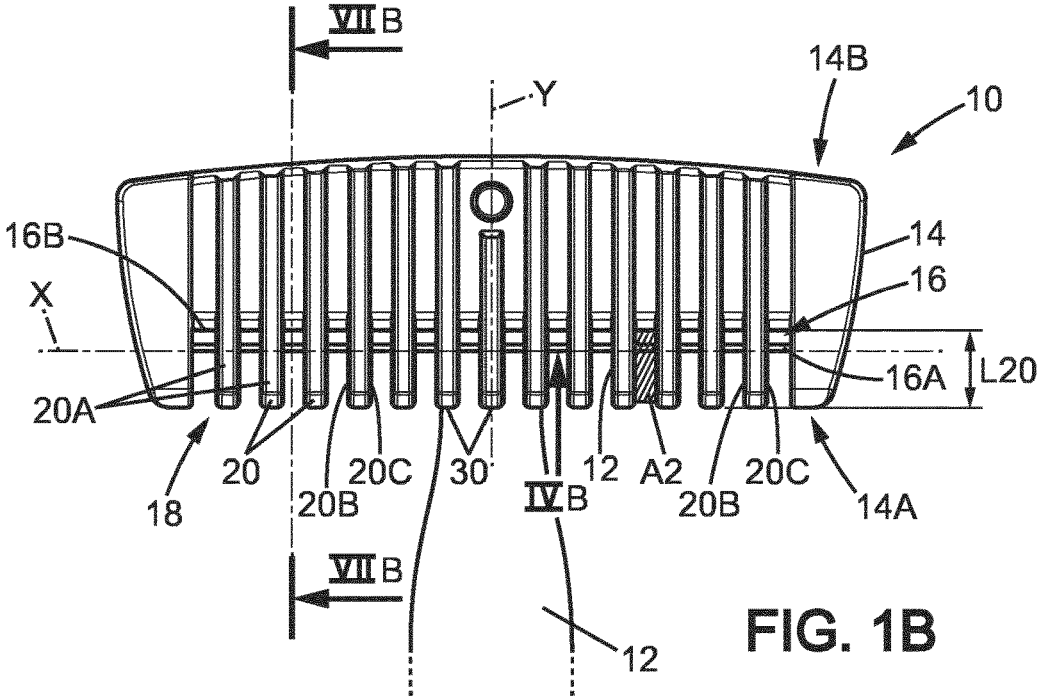
FIG. 1B is a front view of a razor according to another embodiment of the present invention, the razor including a trimming blade head and a razor handle.

As seen on FIGS. 1A and 1B, the trimming blade system 10 is provided on a trimming blade head 14 (or head 14). This trimming blade head 14, according to the present invention, has a front 14A and a rear 14B opposite the front 14A.

Figure 1C:
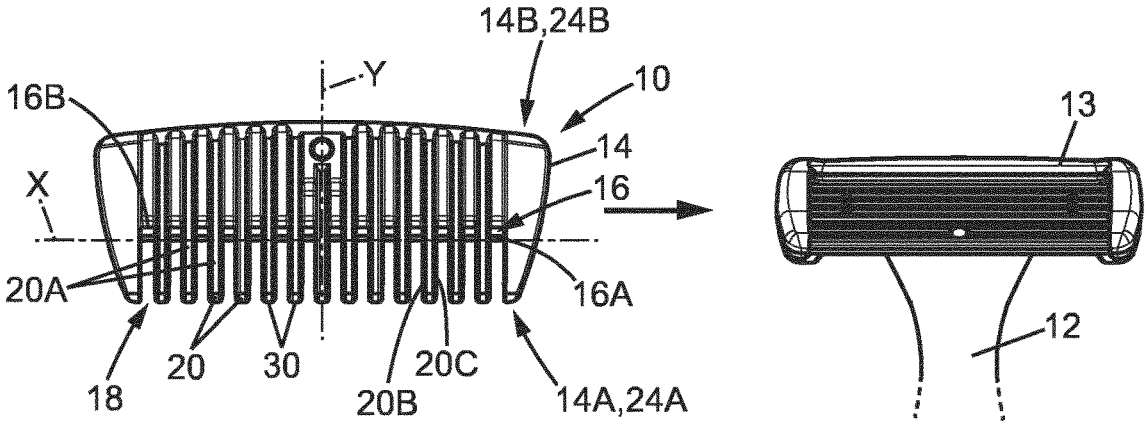
FIG. 1C is a front view of a razor according to another embodiment of the present invention, the razor including a trimming blade system, a shaving head and a razor handle.
Figure 2A:
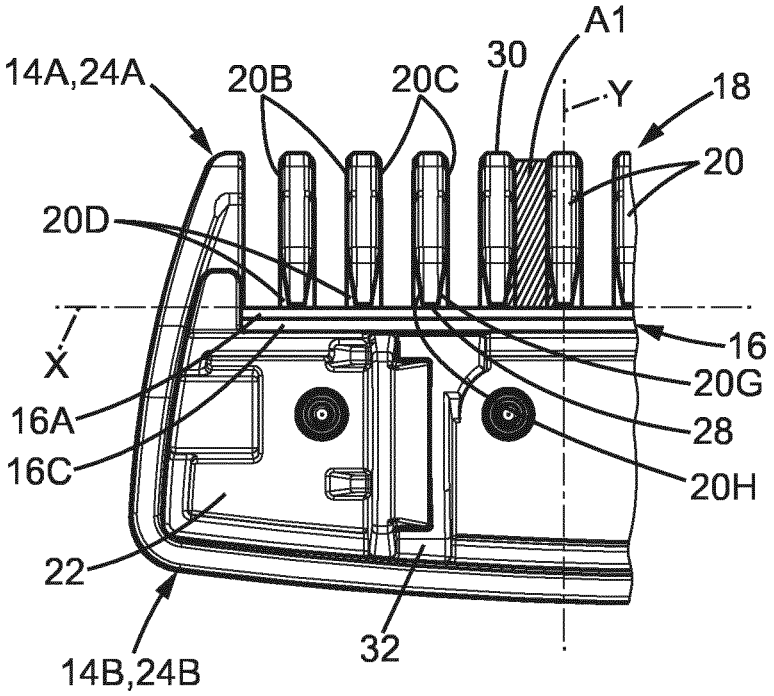
FIG. 2A is a partial lower view of the razor of FIG. 1A.
Figure 2B:
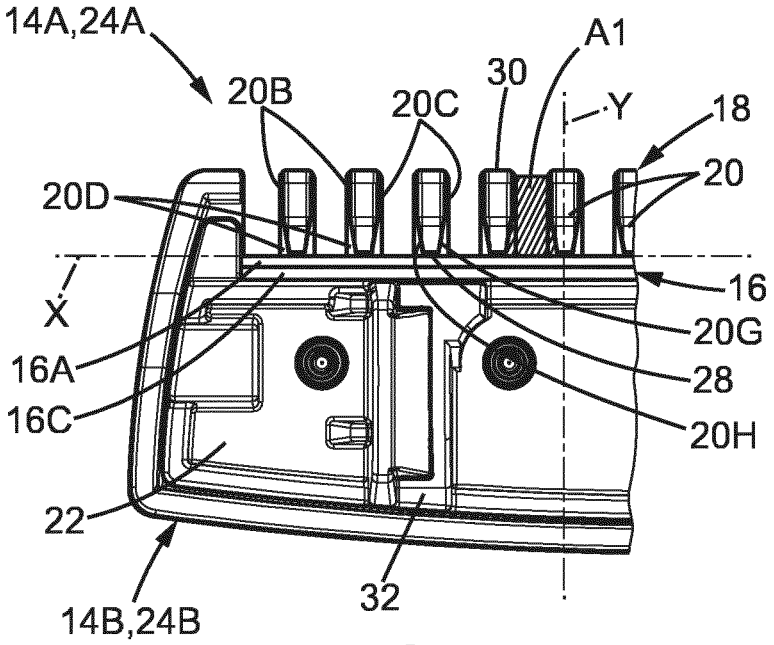
FIG. 2B is a partial lower view of the razor of FIG. 1B.
Figure 3A:
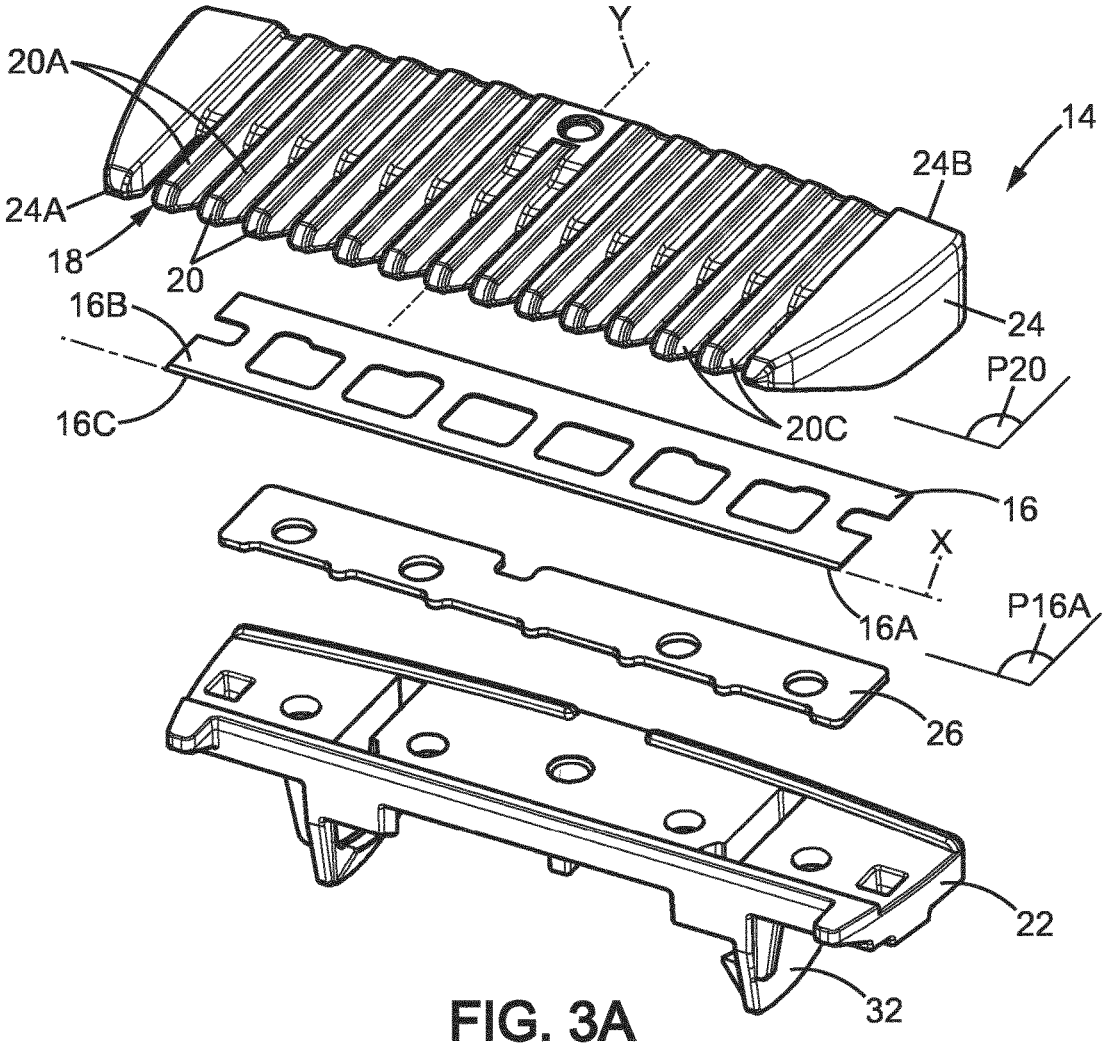
FIG. 3A is a perspective, exploded view of the trimming blade head of FIG. 1A.
Figure 3B:
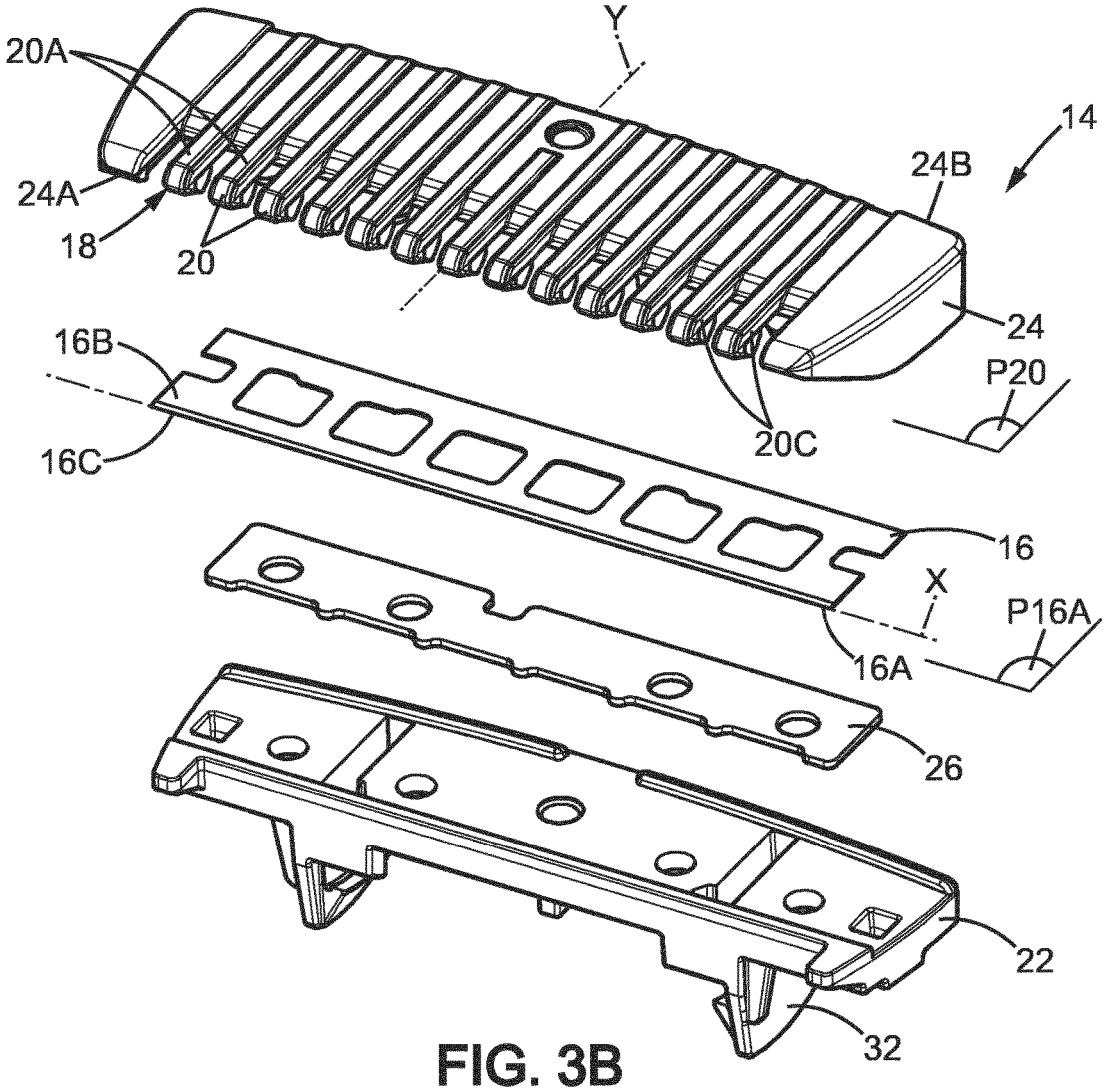
FIG. 3B is a perspective, exploded view of the trimming blade head of FIG. 1B.
Figure 3C:
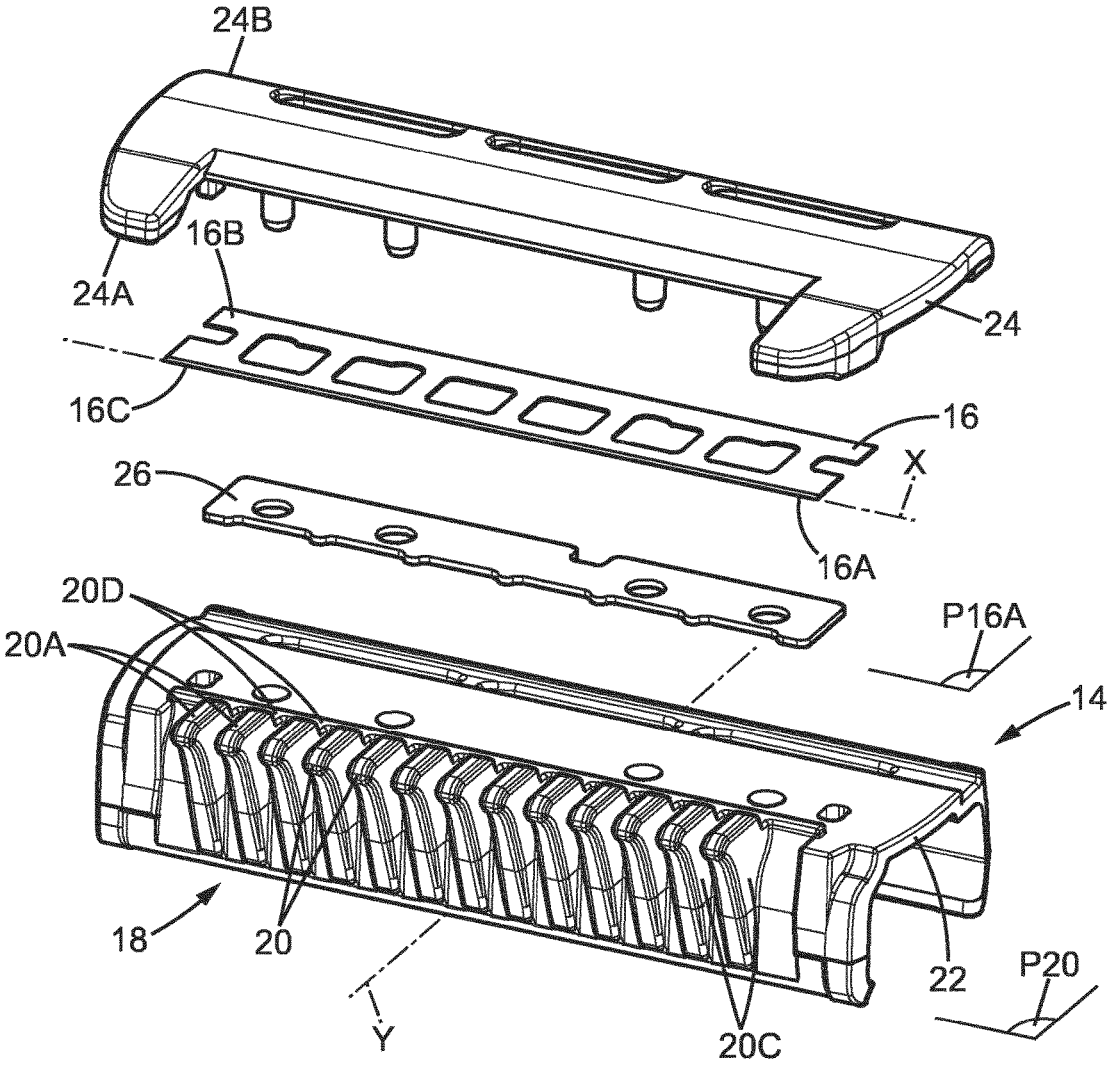
FIG. 3C is a perspective, exploded view of a trimming blade head according to another embodiment of the present invention.
Figure 4A:
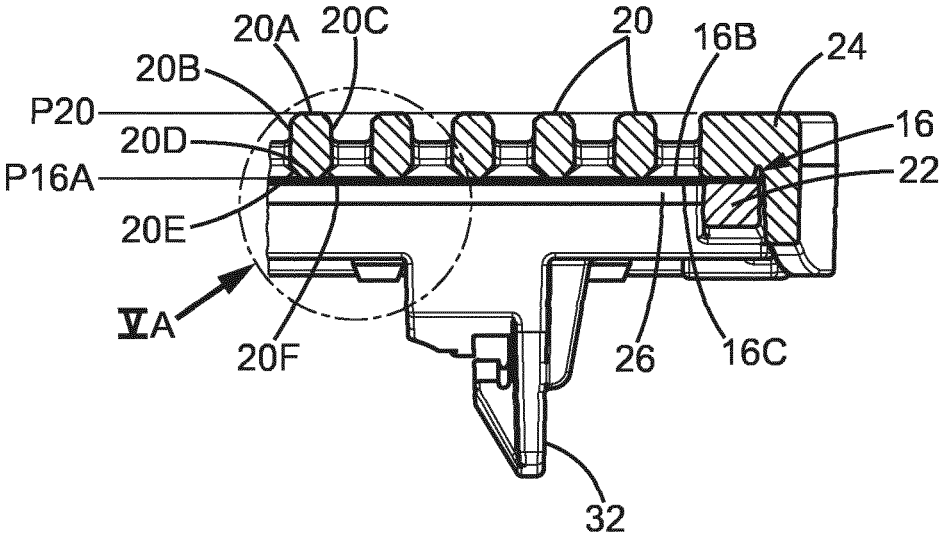
FIG. 4A is a partial longitudinal cross-sectional view of the trimming blade head of FIG. 1A along line IVA-IVA.

FIGS. 1C and 3C illustrate other embodiments of the present invention, in which the trimming blade system 10 is provided on a protector 14 that can be attached to a shaving head 13. In that case, the user can shave traditionally when the trimming blade system 10 is detached from the shaving head 13 and the user can trim when the trimming blade system 10 is attached onto the shaving head 13. For example, the trimming blade system 10 can be slidably attached to the blade head 13. The trimming blade system 10 can also be snap-fitted on the blade head 13.

The following description focuses on a trimming blade head 14 as depicted on FIGS. 1A and 1B; however it also applies to a trimming blade system 10 provided on a protector as depicted on FIG. 1C or 3C.

The trimming blade head 14 includes at least one blade 16, but can be provided with more than one blade. Blade 16 has a cutting edge 16A facing forwardly toward the front 14A of the head 14. The cutting edge 16A can be elongated and defines a longitudinal axis X-X.

The trimming blade head 14 further includes a comb 18 provided with teeth 20. The teeth 20 project forwardly toward the front 14A of the head 14. The teeth 20 overlap the cutting edge 16 (see FIGS. 1A-1B and 2A-2B).

As seen on the exploded view of FIGS. 3A and 3B, the trimming blade head 14 includes a supporting plate 22 and a cover plate 24.

The trimming blade system further has a comb 18 provided with teeth 20.

The comb 18 can be provided on the cover plate 24 as seen on the embodiments of the present invention depicted on FIGS. 1A-1C and 3A-3B.

In another embodiment of the present invention, as depicted on FIG. 3C, the comb 18 can be provided on the support plate 22. The description is given in reference to the embodiments in which the comb 18 is provided on the cover plate 24, but the described features also apply to any other embodiments of the present invention, for example to the one in which the comb 18 is provided on the support plate 22, unless a specific description is given for a specific embodiment. The embodiment of the present invention in which the comb 18 is provided on the support plate 22 is disclosed and depicted (see FIG. 3C) with regard to a trimming blade system 10 provided on a protector 14 that can be attached to a shaving head 13; however, one might understand that an embodiment in which the comb is provided on the support plate, the trimming blade system 10 being provided on a trimming blade head 14 (or head 14) is also covered by the present invention.

The present invention concerns a comb provided on a trimming blade system, the trimming blade system being provided either on a trimming blade head (or head), and/or on a protector that can be attached to a shaving head. In each case, the comb can be provided on the cover plate and/or on the support plate.

The front 14A and the rear 14B of the trimming blade head 14 correspond to the front 24A and a rear 24B (opposite the front 24A) of the cover plate 24.

As depicted on the figures, blade 16 can be flat. Blade 16 can be supported by a spacer 26 sandwiched between the blade 16 and the supporting plate 22. When the trimming blade head 14 is provided with several blades (not illustrated), the trimming blade head 14 is accordingly provided with several spacers; the blades and the spacers being alternatively superimposed.

The blade can be supported by a blade support which may be curved. The blade can also be a curved blade.

As illustrated on the figures, each of the teeth 20 has an upper face 20A and two lateral faces 20B and 20C. The lateral faces 20B and 20C of each of the teeth can extend parallel to each other. In other words, the lateral face 20B is parallel to the lateral face 20C of a tooth. In addition, the lateral faces 20B and the lateral faces 20C of all the teeth are parallel each other.

The lateral faces 20B and 20C of each of the teeth 20 can extend transversally to the longitudinal axis X-X (see FIGS. 1A-1B and 2A-2B). Lateral faces 20B and 20C of each of the teeth 20 can extend along a transversal axis Y-Y. The axis Y-Y can be oblique, or as illustrated on FIGS. 1A and 1B, can be perpendicular to the longitudinal axis X-X when the faces 20B and 20C of each of the teeth are perpendicular to the cutting edge 14A.

As seen on FIGS. 2A-2B and 4A and 4B, each of the teeth 20 has a lower face 20D. The lower face 20D of each of the teeth 20 can be flat as seen on FIGS. 4A-4B, 5A-5B and 6A-6B. The lower face 20D of each of the teeth 20 is partly adjacent to the blade 16. The blade 16 has an upper face 16B and a lower face 16C (opposite the upper face 16B). In the embodiments of the present invention in which the comb 18 is provided on the cover plate 24 as depicted on FIGS. 2A-2B and 4A and 4B, the lower face 20D of the teeth 20 is in contact with the upper face 16B of the blade 16. In the embodiment of the present invention in which the comb 18 is provided on the support plate 22 as depicted on FIG. 3C, the lower face 20D of the teeth is in contact with the lower face 16C of the blade 16 or at least is in front of the blade.

Due to the comb 18, the teeth 20 form, during trimming, an obstacle to the blade 16 for the hairs. In order to increase the active length of the blade 16, the lower face 20D of each of the teeth 20 is joined to the lateral faces 20B-20C by opposite chamfered faces 20E and 20F. In other words, all things being equal, when considering an effective area located between the teeth, the effective area A1 of the teeth (see FIGS. 2A and 2B) according to the present invention (for example, provided with chamfered faces 20E, 20F) is greater than the effective area A2 of teeth provided without chamfered faces (equivalent to area A2 depicted on FIGS. 1A-1B).

Figure 5A:
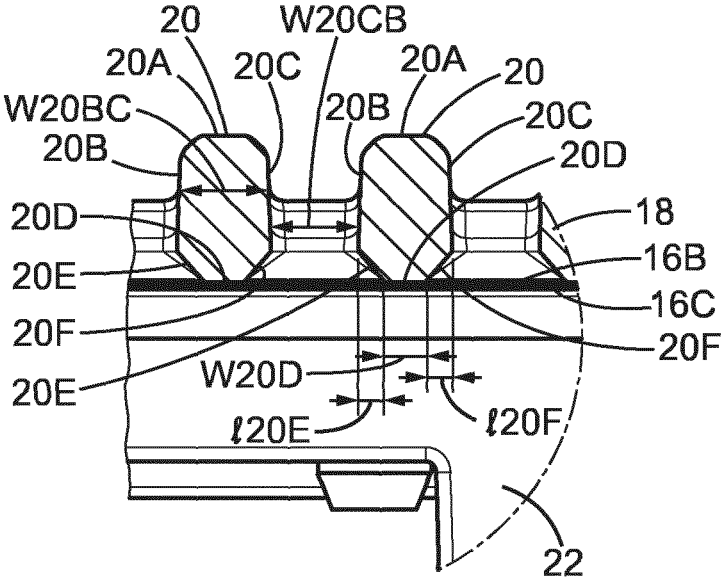
FIG. 5A is a detailed cross-sectional view of trimming blade head of FIG. 4A.
Figure 4B:
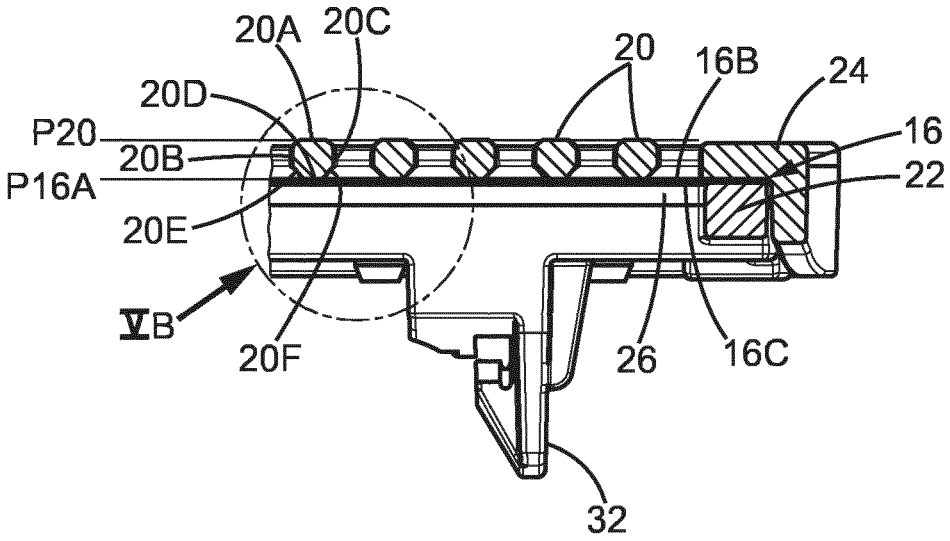
FIG. 4B is a partial longitudinal cross-sectional view of the trimming blade head of FIG. 1B along line IVB-IVB.
Figure 5B:
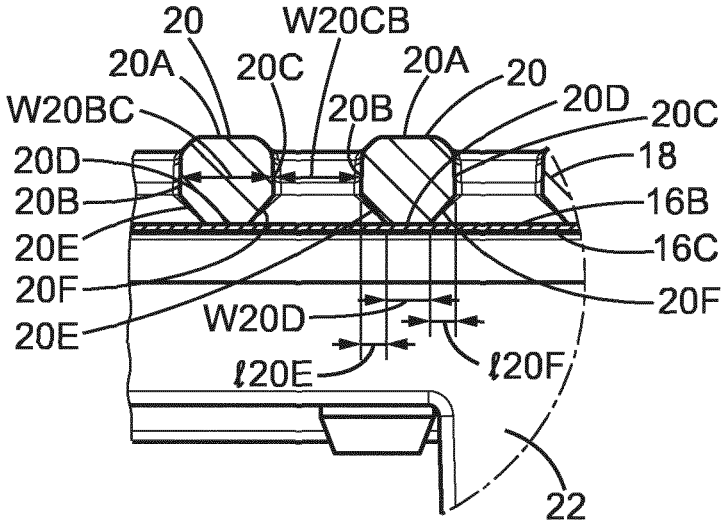
FIG. 5B is a detailed cross-sectional view of the trimming blade head of FIG. 4B.
Figure 6A:
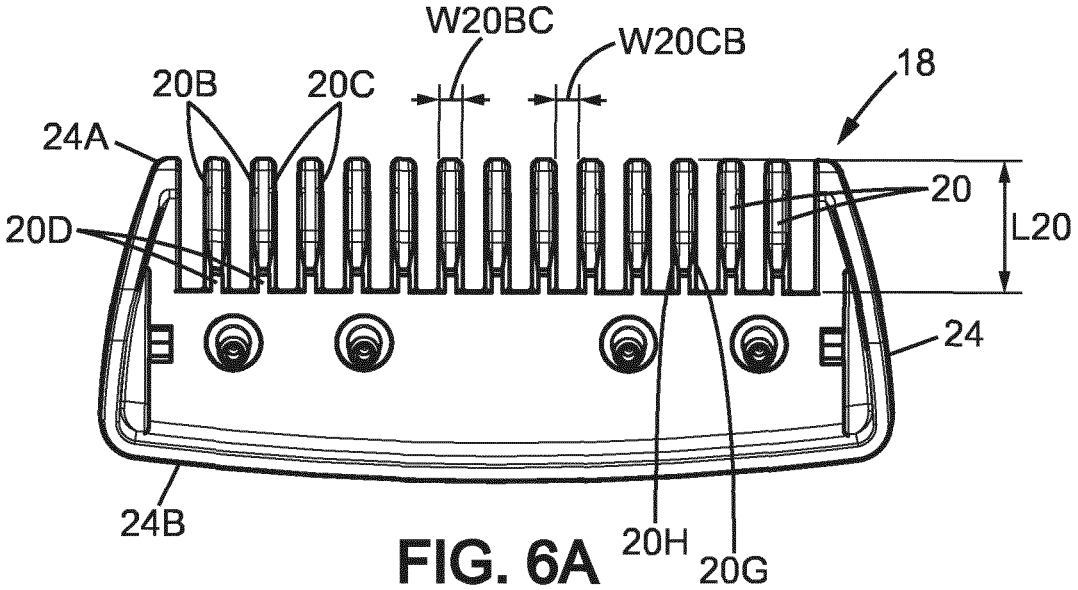
FIG. 6A is lower view of the cover plate of the trimming blade head of FIG. 1A.
Figure 6B:
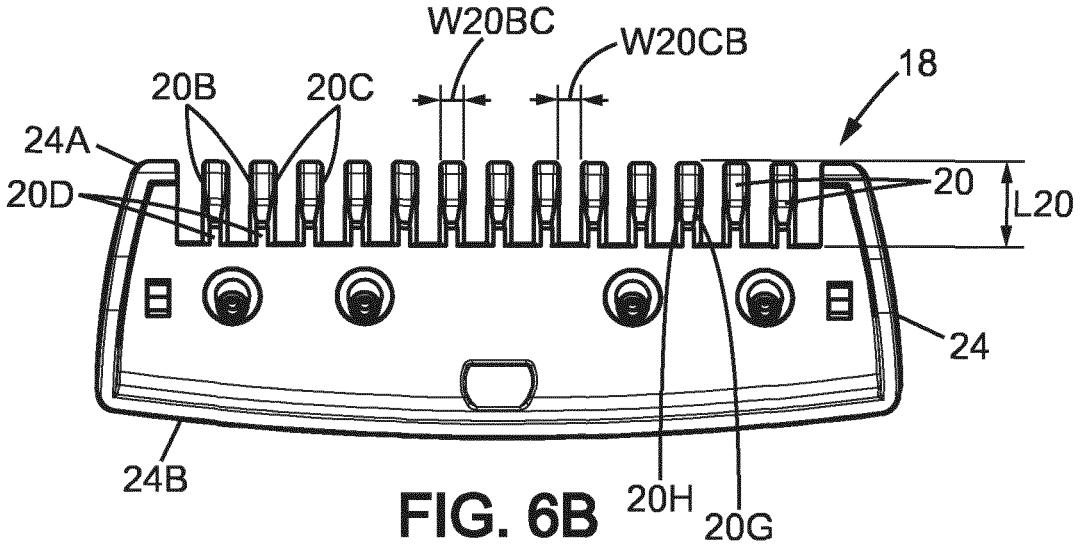
FIG. 6B is lower view of the cover plate of the trimming blade head of FIG. 1B.
Figure 7A:
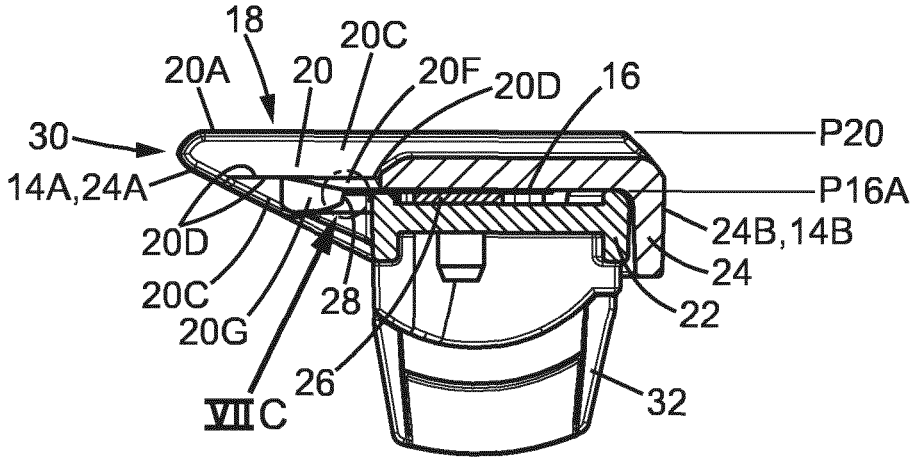
FIG. 7A is a transversal cross-sectional view of the trimming blade head of FIG. 1A along line VIIA-VIIA.
Figure 7B:
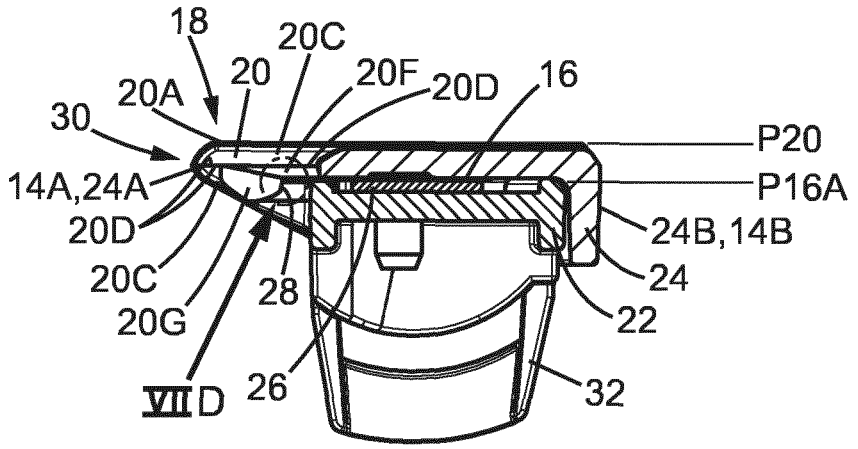
FIG. 7B is a transversal cross-sectional view of the 5 trimming blade head of FIG. 1B along line VIIB-VIIB.
Figure 7C:
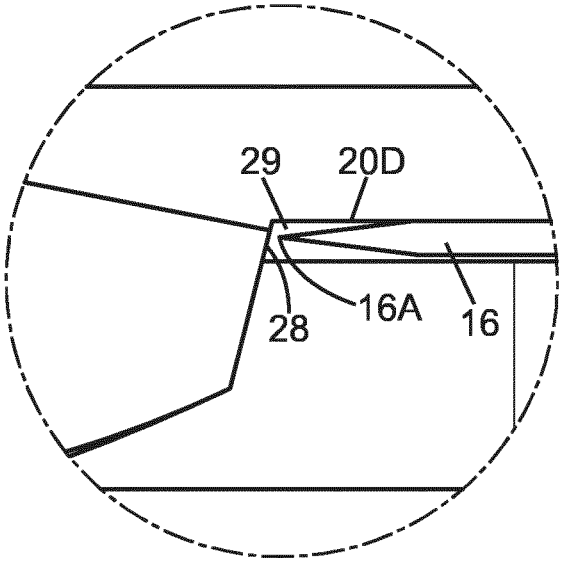
FIG. 7C is a partial view of detail VIIC of the trimming blade head of FIG. 7A.
Figure 7D:
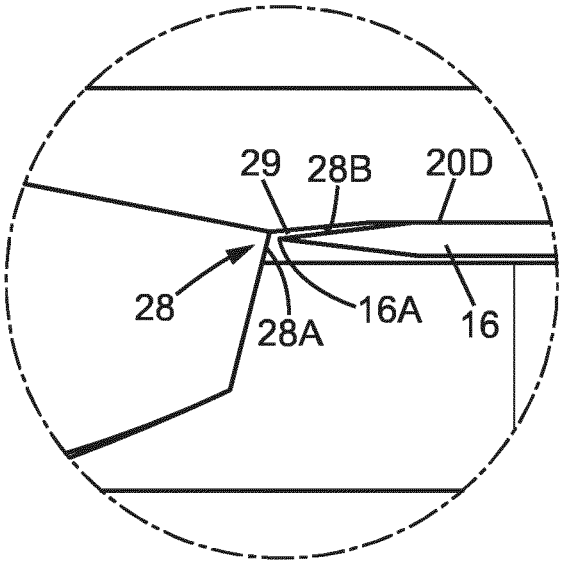
FIG. 7D is a partial view of detail VIID of the trimming blade head of FIG. 7B.
Figure 8A:
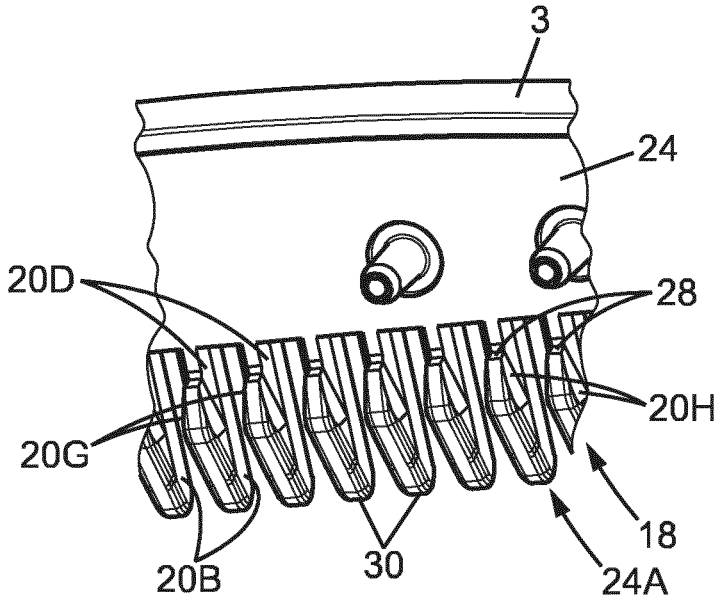
FIG. 8A is a partial lower perspective view of the cover plate of the trimming blade head of FIG. 1A.
Figure 8B:
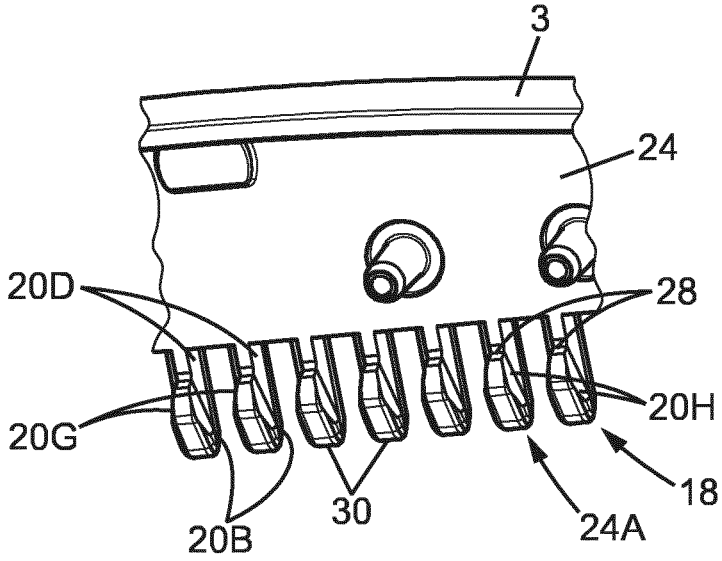
FIG. 8B is a partial lower perspective view of the cover plate of the trimming blade head of FIG. 1B.

In reference to FIGS. 5A-5B, the lower face 20D of each of the teeth is joined to the lateral face 20B by the chamfered face 20E, and the lower face 20D of each of the teeth is joined to the lateral face 20C by the chambered face 20F. Therefore, for a given blade's length, the active length of the cutting edge 16 is increased when compared to the same blade with a comb the teeth of which are not chamfered. With the present invention, the number of teeth does not need to be increased to increase the active length of the blade. With the present invention, the available space in front of the cutting edge of the blade is increased; thus, the number of hairs cut during one single stroke may be increased.

The dimensions of the teeth 20 can be defined as follows:

W20BC: width of one tooth between the lateral faces 20B and 20C of one tooth 20 (along the longitudinal axis X-X)

W20CB: interval between two adjacent teeth between corresponding lateral face 20C of one tooth and corresponding lateral face 20B of tooth adjacent to the one tooth (along the longitudinal axis X-X)

W20D: width of one tooth between the chamfered faces 20E and 20F of one tooth 20 (along the longitudinal axis X-X), measured on the smallest width which corresponds to the width of the lower face 20D.

According to the present invention, the teeth 20 are spaced from each other by an interval W20CB having a value which can be between about 1 mm and about 5 mm.

The teeth 20 have a width W20BC having a value which can be between about 1 mm and about 4 mm.

The number of teeth 20 is between 10 and 20.

As an example, for a cutting edge having a length of 35.0 mm and thirteen teeth of a width W20BC of about 1.37 mm, the active length of the cutting edge is about 17.1 mm when the teeth are not provided with chamfered faces, whereas the active length is about 26.2 mm when the teeth are chamfered and the width W20D is reduced to about 0.68 mm. Thus, with these dimensions of the teeth, for a given blade's length, the active length of the cutting edge 16 is increased by up to about 53%.

As depicted on the Figures, the chamfered faces 20E and 20F can be opposite one another and the tooth is symmetric; in other words, the reduced width W20D is obtained by the subtraction of two identical values .e20E and .e20F (see FIGS. 5*a* and 5B). The teeth can also be asymmetric; in which case the value of .e20E is different from the one of .e20F. In any case, the increase of the active length of the blade corresponds to the addition of the .e20E and .e20F by the number of teeth.

The teeth 20 have a length L20 having a value which can be between about 1 mm and about 15 mm. In the example illustrated on FIGS. 1A-8A, the length L20 of the teeth 20 is about 2 mm, whereas the length L20 of the teeth 20 is about 1 mm in the example illustrated on FIGS. 1B-8B.

When the comb 18 is provided on the cover plate 24, the upper face 20A of the teeth 20 defines a trimming plane P20. The upper face 20A of each of the teeth can be flat and the upper faces 20A all the teeth are coplanar. A blade plane P16A can be defined; the blade 16 is generally flat (see FIGS. 3A and 3B) and extend in a plane; more precisely both faces 16B and 16C of the blade 16 are in two planes which are parallel and the cutting edge 16A is included in the blade plane P16A which is parallel to both planes containing faces 16B and 16C; the blade plane P16A is also parallel to the trimming plane P20 (as seen on FIGS. 7A and 7B).

As depicted on FIGS. 7A-7B and 8A-8B, the teeth 20 can be stepped to form rearwardly directed shoulders 28 against which the cutting edge 16A is positioned. The teeth 20 define elbows extending forwardly toward the front 14A of the head 14.

In other words, each tooth has a portion that folds back on itself; proximate to the elbow 30, the upper face 20A of each tooth 20 is folded inward toward the lower face 20D and toward the cutting edge 16A. Proximate to the elbow 30, the lower face 20D of each of the teeth 20 is facing each other, contacting each other.

In addition, the teeth 20 can be tapered toward the shoulder 28. Proximate to the blade 16, as in the vicinity of the elbow 30, the lateral faces 20B and 20C are parallel each other. However, the shoulder 28 is connected to these lateral faces 20B and 20C via oblique faces 20G and 20H. The fact that the lateral faces 20B and 20C join the shoulder 28 in being tapered reduce the possibility of hairs clogging; unwanted hairs can be trapped in the gap 29 provided between the cutting edge 16A and the shoulder 28. With the oblique faces 20G and 20H, this gap 29 is reduced.

The oblique faces or chamfers 20E, 20F, 20G, 20H are provided to increase the effective cutting area, and to increase blade edge contact. The shoulder 28 against which the cutting edge 16A is positioned can be either a sole rectilinear face, directly arriving to the corresponding lower face 20D of each of the teeth 20 as depicted in detail on FIG. 7C. The shoulder 28 can also be in two rectilinear parts as depicted in detail on FIG. 7D. The shoulder 28 has, in the latter case shown in FIG. 7D, a first face 28A and an oblique face 28B transversal to both faces 28A and 20D, defining an additional shoulder chamfer 28B. The shoulder chamfer 28B reduces clogging by closing (for example reducing substantially) the gap 29 that may exists between the blade edge 16A and the shoulder 28. In order to be connected to a razor handle 12 as depicted on FIGS. 3A-3B, the trimming blade head 14 is provided with connecting means 32. These connecting means 32 can allow a pivotal motion of the trimming blade head 14 with regard to the razor handle 12 along a pivotal axis (not illustrated). The pivotal axis can be parallel to the longitudinal axis X-X. When the trimming blade head 14 is pivotally connected to the razor handle 12, the connecting means 32 can include shell bearings 32.

A lock and release mechanism (not illustrated) can be provided such that the trimming blade head can be attached to and detached from the razor handle.

The supporting plate 22, like the cover plate 24 may include many materials. In at least one example, the material can include a plastic, for instance a thermoplastic like ABS. In some cases, it may be desired to have a metal cover plate to improve accuracy. The comb 18 and its teeth can be made unitary with the cover plate 24 in order to form one element.

The invention claimed is:

1. A trimming blade system having a front and comprising: a supporting plate; a blade; and a cover plate, the blade having a cutting edge facing forwardly toward the front of the trimming blade system, the trimming blade system having a comb provided with teeth which project forwardly toward the front of the trimming blade system and which overlap the cutting edge, each of the teeth having an upper face, two lateral faces, and a lower face, the lower face of each of the teeth is joined to the lateral faces by opposite chamfered faces to form a shoulder, each one of the teeth is tapered toward the shoulder and is adjacent to an upper face of the blade, and the cutting edge is positioned adjacent the shoulder.

2. The trimming blade system of claim 1, wherein the teeth are stepped so the shoulders form rearwardly directed shoulders against which the cutting edge is positioned.

3. The trimming blade system of claim 2, wherein each of the shoulders is provided with a shoulder chamfer.

4. The trimming blade system according to claim 1, wherein each of the teeth defines an elbow extending forwardly toward the front of the trimming blade system.

5. The trimming blade system according to claim 1, wherein the lower face of each of the teeth is flat, and wherein the lower face of each of the teeth is in contact with the blade.

6. The trimming blade system according to claim 1, wherein the lateral faces of each of the teeth extend parallel to each other.

7. The trimming blade system according to claim 1, wherein the cutting edge is elongated and defines a longitudinal axis, and wherein the lateral faces of each of the teeth extend parallel to each other and extend transversally to the longitudinal axis.

8. The trimming blade system according to claim 1, wherein the cutting edge is elongated and defines a longitudinal axis, and wherein the lateral faces of each of the teeth extend parallel to each other and extend perpendicularly to the longitudinal axis.

9. The trimming blade system according to claim 1, wherein the teeth are spaced from each other by an interval having a value between about 1 mm and about 5 mm.

10. The trimming blade system according to claim 1, wherein each of the teeth has a length having a value between about 1 mm and about 15 mm.

11. The trimming blade system according to claim 1, wherein each of the teeth has a width having a value between about 1 mm and about 4 mm.

12. The trimming blade system according to claim 1, wherein the number of teeth is between 10 and 20.

13. The trimming blade system according to claim 1, further comprising a spacer sandwiched between the blade and the supporting plate.

14. The trimming blade system according to claim 1, wherein the comb is provided on the cover plate.

15. The trimming blade system according to claim 1, wherein the comb is provided on the support plate.

16. The trimming blade system according to claim 14, wherein the upper face of the teeth defines a trimming plane, and wherein the cutting edge is comprised in a blade plane which is parallel to the trimming plane.

17. A razor comprising a razor handle and a trimming blade system according to claim 1, wherein the trimming blade system is provided with connecting means for connecting the trimming blade system to the razor handle.

18. A razor comprising a razor handle; a shaving head; and a trimming blade system according to claim 1, wherein the shaving head is provided with connecting means for connecting the shaving head to the razor handle.

19. The razor according to claim 17, wherein the connecting means comprises shell bearings.

20. A trimming blade system having a front and comprising: a supporting plate; a blade; and a cover plate, the blade having a cutting edge facing forwardly toward the front of the trimming blade system, the trimming blade system having a comb provided with teeth which project forwardly toward the front of the trimming blade system and which overlap the cutting edge, the teeth are stepped to form rearwardly directed shoulders provided with shoulder chamfers, and wherein the cutting edge is positioned against the shoulders such that a lower face of the teeth is adjacent to an upper face of the blade.

* * * * *